United States Patent [19]

Janssen et al.

[11] Patent Number: 5,042,361

[45] Date of Patent: Aug. 27, 1991

[54] BREECHBLOCK MECHANISM FOR A GUN

[75] Inventors: Karl-Egon Janssen, Meerbusch; Heinz-Günter Breuer, Duisberg, both of Fed. Rep. of Germany

[73] Assignee: Rheinmetall GmbH, Düsseldorf, Fed. Rep. of Germany

[21] Appl. No.: 434,675

[22] Filed: Oct. 25, 1989

[30] Foreign Application Priority Data

Feb. 26, 1988 [DE] Fed. Rep. of Germany ..... 3806123

[51] Int. Cl.[5] ..... F41A 3/10; F41A 3/74

[52] U.S. Cl. ..... 89/24; 89/26

[58] Field of Search ..... 89/22-26, 89/4.2; 42/23

[56] References Cited

U.S. PATENT DOCUMENTS

| | | | |
|---|---|---|---|
| 1,460,683 | 7/1923 | Schneider | 89/22 |
| 1,576,962 | 3/1926 | Froelich | 89/24 |
| 2,998,755 | 9/1961 | Thierry | 89/26 |
| 3,099,937 | 8/1963 | Bartels | 89/24 |
| 3,434,381 | 3/1969 | Thierry | 89/24 |
| 4,308,785 | 1/1982 | Samuel | 89/24 |
| 4,548,121 | 10/1985 | Janssen et al. | 89/26 |
| 4,566,368 | 1/1986 | Bartolles | 89/26 |
| 4,709,616 | 12/1987 | Bartolles | 89/26 |

FOREIGN PATENT DOCUMENTS

| | | | |
|---|---|---|---|
| 0014559 | 8/1980 | European Pat. Off. | 89/24 |
| 3520418 | 12/1986 | Fed. Rep. of Germany | 89/24 |
| 885361 | 12/1961 | United Kingdom | 89/24 |

OTHER PUBLICATIONS

Rheinmetall; "Handbook on Weaponry", 1982, pp. 340-341.

Rheinmetall; "Waffentechaisches Taschenbuch", 1980, pp. 312-313.

*Primary Examiner*—Deborah L. Kyle

*Assistant Examiner*—Stephen Johnson

*Attorney, Agent, or Firm*—Spencer & Frank

[57] ABSTRACT

It is known to arrange a breech mechanism for a gun so as to be displaceable within a parallel guide arranged at a right angle to the bore axis of the gun barrel, and to bring a mushroom shaped head for obturation to the chamber in a partial circular arc. Due to the plurality of drive means for the mushroom head, complicated motion sequences result within the breechblock system which may lead to increased susceptibility to malfunction and do not permit high firing rates. Such a breech mechanism is not suitable or the use of a highly elastic obturator disposed in the gun barrel. The invention makes it possible to provide a wedge-shaped insert (12), which is to seal an elastic obturator (8) disposed at the end of the gun barrel (3), so as to be movable on a sloped slide face (10) of a breechblock (9) which is guided in parallel in the breech ring (5) and is movable transversely to the bore axis (2) of the gun barrel, and to utilize the movement of the breechblock (9) in a simple manner initially for the closing stroke and thereafter for the sealing stroke of the wedge-shaped insert (12) exclusively in the direction of the bore axis. Since the sealing stroke takes place exclusively in the direction of the bore axis (2), it is possible to realize a uniform and defined tension in the obturator (8).

6 Claims, 2 Drawing Sheets

BREECHBLOCK MECHANISM FOR A GUN

BACKGROUND OF THE INVENTION

The present invention relates to a breechblock mechanism for a gun. More particularly, the present invention relates to a breech mechanism which is displaceably arranged within a parallel guideway disposed in the gun barrel breech ring at a right angle to the bore axis of the gun barrel, and which is provided with means for obturation which are movable transversely to the direction of displacement within the guideway.

In such a breech mechanism, as it is disclosed in EP 00 14 559, it is necessary to seal the chamber by bringing a mushroom shaped head of the breech mechanism in a partial arc to the charge chamber. For this purpose, it is necessary to provide roller guides, a coupling rod assembly and, in addition, stages for determining the "open" and "closed" breech positions, with such stages being disposed in a driving member. Due to the large number of driving means for the mushroom head, complicated motion sequences result within the breech system which may lead to increased susceptibility to malfunction and do not permit high firing rates.

The book by Rheinmetall, entitled "Waffentechnisches Taschenbuch" [Handbook on Weaponry] 6th Edition, 1983, page 313, FIG. 862, also discloses the sealing of the chamber against the breech wedge by means of a steel obturator ring.

However, this breech wedge does not permit the use of elastically deformable ring obturators containing high percentages of plastics as disclosed, for example, in U.S. Pat. No. 1,460,683 instead of the steel obturator ring because, due to the simultaneous radial and axial direction of movement of the breech wedge and a greater sealing stroke required to tension the elastically deformable ring obturator, it is possible for the breech wedge to move in a way which enhances wear of the seal. Moreover, if, for example, a sealing ring as disclosed in U.S. Pat. No. 1,460,683 is employed, no long-term sealing effect can be realized for such an application because the elastically deformable sealing ring is able to escape toward the chamber due to the absence of a support in the interior.

In contrast thereto, it is an object of the invention to improve the prior art breech mechanism of the type including a breechblock which is displaceably guided in a parallel guideway disposed in the gun barrel breech ring at a right angle to the bore axis of the gun barrel and which is provided with means movable transversely to the displacement direction for obturation so that a reliable and durable seal can be obtained at high firing rates for elastically deformable ring obturators which are fixed to the end of the gun barrel, with such seal being obtained by simple kinematics and a robust support within the breech mechanism.

SUMMARY OF THE INVENTION

The above object is generally achieved according to the present invention by a breech mechanism of the type including a breechblock which is displaceably arranged within a parallel guideway disposed in the gun barrel breech ring at a right angle to the bore axis of the gun barrel, and which includes a member movable transversely to the breechblock displacement direction for obturation, and wherein: the breechblock guided in the parallel guideway of the breech ring is provided with a sloped slide face which extends at an angle relative to the parallel guideway, and with a wedge-shaped insert which is provided for obturation and which performs a sealing stroke exclusively on the bore axis; a stroke limiting means for the insert is provided to interrupt the movement of the insert in the same direction as the breechblock during a closing movement and to cause the insert to perform the sealing stroke oriented in the direction of the bore axis; to enable the wedge-shaped insert to take up an intermediate position behind the obturator ring before the sealing stroke is performed, the wedge-shaped insert is connected to the breechblock via means for normally causing movement of the insert in synchronism with movement of the breechblock; and the wedge-shaped element has a frontal face facing away from a sloped slide face of the wedge-shaped insert which slides on the sloped face of the breechblock, with this frontal face being configured as the sealing face for the obturator ring, which can be tensioned in a uniform and defined manner, and being arranged perpendicularly to the bore axis of the gun barrel. Advantageous features and modifications of the invention are likewise disclosed.

The invention makes it possible in an advantageous manner to seal an elastically deformable obturator ring disposed at the end of the gun barrel by means of a wedge-shaped insert on a sloped face of a breechblock which is guided in parallel in the breech ring and is movable transversely to the bore axis of the gun barrel, and to utilize the movement of the breechblock in a simple manner initially for the closing stroke and thereafter for a sealing stroke by the wedge-shaped insert oriented exclusively in the direction of the bore axis of the gun barrel. Due to the fact that the sealing stroke is taking place exclusively in the direction of the bore axis of the gun barrel, a uniform and defined tension can be produced in the seal. To perform the sealing stroke, initially the movement of the wedge-shaped insert during closing of the breechblock, which goes in the same direction, is interrupted in an uncomplicated manner by stroke limiting means, preferably fastened to the breech ring, so that the movement of the wedge-shaped insert over the sloped slide faces of the insert and of the breechblock can be converted, due to the continuing movement of the breechblock, directly into a movement on the side of the gun barrel exclusively along the bore axis of the gun barrel.

The comparatively large mass of the breechblock can here be driven in a known manner without noticeably changing the drive system, with the mass of the wedge-shaped insert to be controlled remaining small and not requiring drive means of its own. Because of this and because the conversion of the movement of the wedge-shaped insert can also occur without interruption of the movement of the breechblock, nevertheless ensuring a stable and reliable support, operation at a high rate of repetition becomes possible.

Due to the exclusively axial movement of the wedge-shaped insert, the breech mechanism according to the invention ensures a defined tension in a highly elastic seal and thus a reliable and durable sealing of the chamber. This permits the use of ammunition provided with fully combustible casings or the use of liquid fuels in artillery weapons or tank cannons. Moreover, the invention makes it possible to realize favorable manufacturing conditions as they are produced, for example, by the simplified manufacture of a parallel guidance compared to the complicated wedge-shaped guidance for the breech ring. The simple structure additionally makes it possible to easily adapt an automatic loading mechanism.

The invention will be described below in greater detail with reference to embodiments thereof that are illustrated in the drawing figures.

DETAILED DESCRIPTION OF THE PREFERRED EMBODIMENTS

Figure 1:
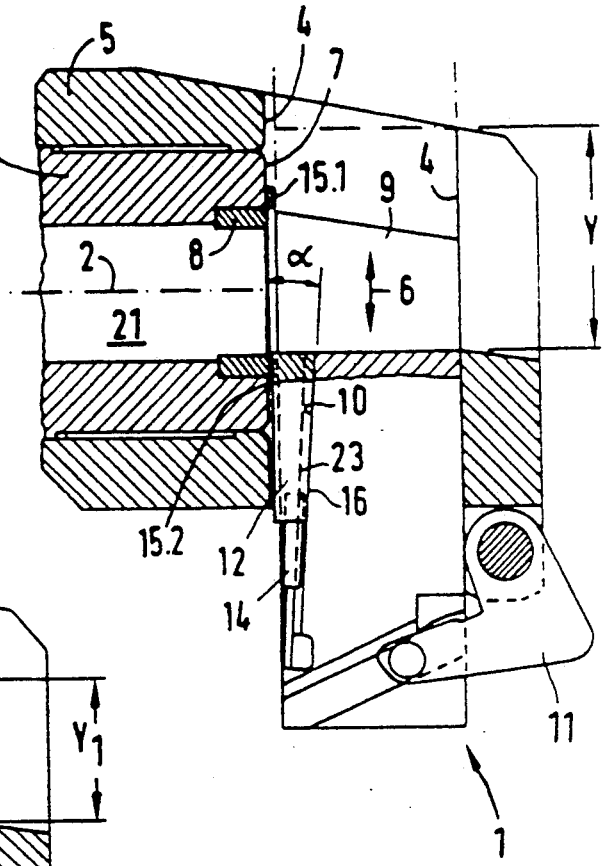
FIGS. 1 to 3 are each a longitudinal sectional view of a gun barrel equipped with a first embodiment of a breech mechanism according to the invention, with FIGS. 1 to 3 showing various positions in the movement of the breech mechanism.
Figure 2:
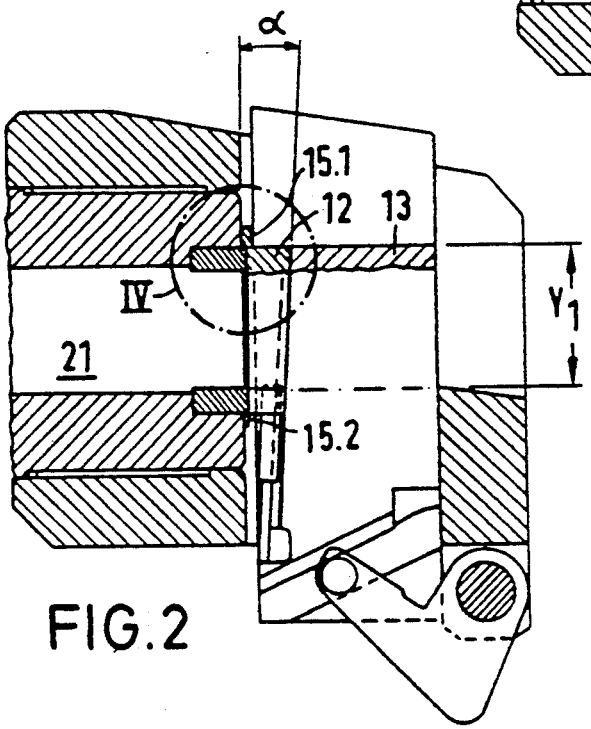
Figure 3:
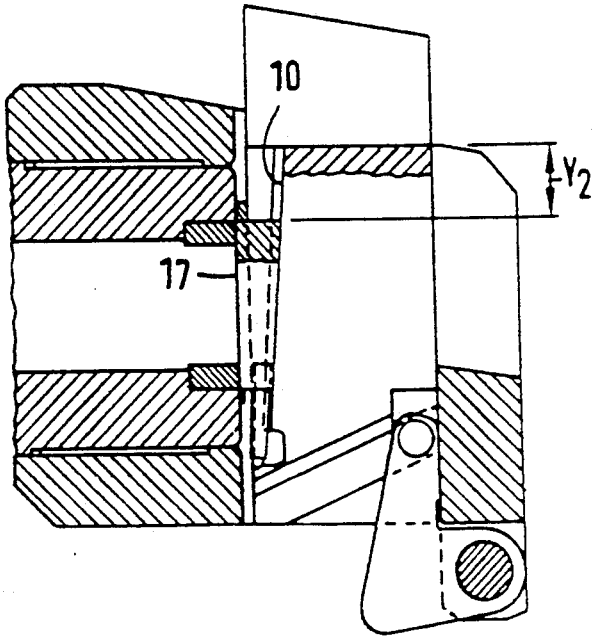

The breech ring 5 of a gun barrel 3 of an artillery weapon or tank cannon shown in FIGS. 1 to 3 includes a parallel guideway 4 disposed at a right angle to the bore axis 2 of the gun barrel for accommodating a breechblock 9 which is part of a breech mechanism 1 and which, in a known manner, can be moved automatically by a device 11 but also manually in the displacement direction 6 within parallel guideway 4. Device 11 is disclosed, for example, in EP 00 14 559 so that a detailed description thereof is not necessary.

Breechblock 9 includes a slide face 10 which extends at an angle $\alpha$ relative to the parallel guidewalls 4 obliquely from the bottom left to the top right. This slide face 10 is configured as a guide 23, for example, in the form of a T-groove (not shown) to accommodate a wedge-shaped insert 12. The guide is worked into breechblock 9 from the side facing chamber 21. In order to provide for support in the displacement plane of guide 23, wedge shaped insert 12 is connected with means 14 mounted at the lower end of slide face 10, with the support of means 14 on breechblock 9 being disposed below insert 12 so as to save space.

In order to interrupt movement of insert 12 during the closing of breechblock 9 in the same direction and to perform a sealing stroke $X_1$ (FIG. 4) taking place on bore axis 2 and oriented toward chamber 21, a stroke limiting means 15.1 is fastened on the side of the breech ring 5 above an obturator 8 disposed on the gun barrel 3 at the end of chamber 21.

Stroke limiting means 15.1 is configured as a control cam, preferably in the form of a stop 18 for wedge-shaped insert 12 and has a width which is greater than the sealing stroke $X_1$ of insert 12. In order to perform a transverse stroke in direction 6 without touching obturator 8, the guide face of breechblock 9 disposed in parallel guideway 4 is set back relative to the breech ring 5 in the region of this stop 18 by a minimum distance X which is greater than sealing stroke $X_1$. This prevents damage to the obturator 8 as a result of the transverse movement of breechblock 9.

Figure 4:
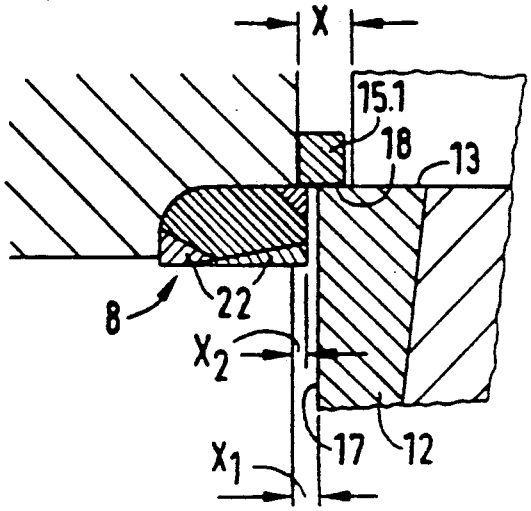
FIG. 4 is a detail of the region marked IV in FIG. 2.

Up to the moment of abutment at stop 18, the frontal or end face 17 (FIG. 3) which faces away from the sloped slide face 16 of wedge-shaped insert 12, and which is configured as a sealing face, is disposed perpendicularly to the bore axis 2 of the gun barrel and lies at a distance corresponding to sealing stroke $X_1$ from the frontal face 7 of the gun barrel 3. This intermediate position 13 taken on by wedge-shaped insert 12 before the sealing stroke $X_1$ is performed is shown in FIGS. 2 and 4. Beginning with the open position of breech mechanism 1 shown in FIG. 1, breechblock 9 and wedge-shaped insert 12 jointly perform stroke $Y_1$ while moving upward transversely to gun barrel 3 until they take on the intermediate position 13 shown in FIGS. 2 and 4.

While breechblock 9 continues to close, and thus continuously moves upward by the stroke $Y_2$ shown in FIG. 3, wedge-shaped insert 12 is prevented by stop 18 from continuing with the joint transverse movement and performs, in a form-locking manner, a separate sealing stroke $X_1$ on the bore axis 2 of the gun barrel over the sloped slide faces 10 and 16 simultaneously with stroke $Y_2$ of breechblock 9.

During sealing stroke $X_1$, the distance changes between the support of mean 14 at the closing stroke and wedge-shaped insert 12. Means 14 is therefore configured as a spring element, preferably a gas pressure spring. Such a gas pressure spring can be compressed in a space saving manner similar to a telescope and ensures, on the one hand, synchronous movement of insert 12 with breechblock 9 until intermediate position 13 is reached and, on the other hand, during an opening stroke $Y = Y_1 + Y_2$, a defined return movement from the closed position of breech mechanism 1 shown in FIG. 3 to the starting position shown in FIG. 1.

However, wedge-shaped insert 12 is able to take on its starting position only after it has distanced itself from frontal face 7 by the amount of sealing stroke $X_1$ since, until it takes on intermediate position 13, return of insert 12 into the starting position (FIG. 1) is initially prevented by a second control cam 15.2 which is disposed adjacent the breech end of gun barrel 3 below obturator 8 and has a guide track corresponding to sealing stroke $X_1$.

The highly elastic sealing ring shown as obturator 8 in FIG. 4 includes, within the chamber 21, two overlapping rings 22 of a wear resistant, preferably hardened material. Thus, the highly elastic seal, which in weaponry is also referred to as a "plastic obturator," is covered toward chamber 21. Since rings 22 and a further ring which protects the last free corner of the seal are slotted, the seal can be elastically deformed, particularly upset, during sealing stroke $X_1$ by the tension $X_2$. The overlap permits steel rings 22 to slide against one another during the sealing process. The sealing effect produced under the axial tension is augmented by the pressure of the propellant gases acting on the interior of rings 22 when a shot is fired.

In dependence on the tensioning stroke $X_2$ of the seal, the slope angle $\alpha$ of sloped slide face 10, 10.1, 16 may be selected to be larger or smaller within the range of self-locking. For example, with a seal tension $X_2$ of 5 mm, the slope may be at an angle $\alpha$ of 4°.

Figure 5:
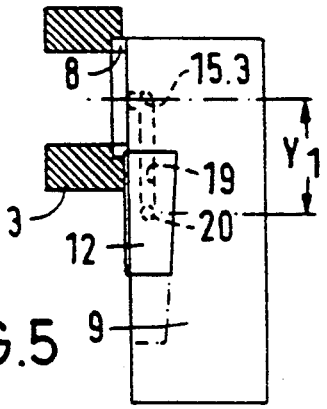
FIGS. 5 and 6 are schematic representations of two positions in the movement of a second embodiment of a breech mechanism according to the invention.
Figure 6:
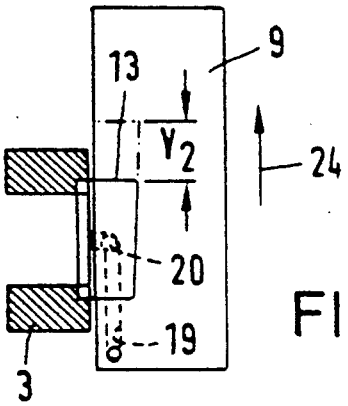

In a further embodiment shown in FIGS. 5 and 6, the stroke limiting means 15.3 of wedge-shaped insert 12 is composed of at least one cam track 19 disposed on breech ring and a cam 20 disposed on insert 12, with cam track 19 being configured in such a manner that wedge-shaped insert 12, in order to take up intermediate position 13, performs an exclusively radial stroke and can be moved only along bore axis 2 to perform the sealing stroke. For this purpose, cam track 19 initially extends parallel to guide 4 and, after intermediate position 13 has been taken, at an angle toward gun barrel 3 at the height of bore axis 2. FIG. 5 shows the starting position of breech mechanism 1 and FIG. 6 its closed position. Insert 12 and breechblock 9 here initially move together by stroke $Y_1$ in the upward direction 24, while after reaching intermediate position 13, breechblock 9 continues to move upward by stroke $Y_2$.

Figure 7:
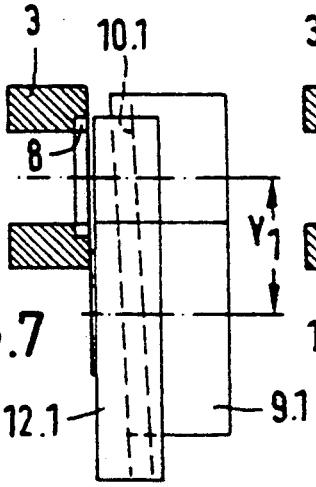
FIGS. 7 and 8 are schematic representations of two positions in the movement of a third embodiment of a breech mechanism according to the invention.
Figure 8:
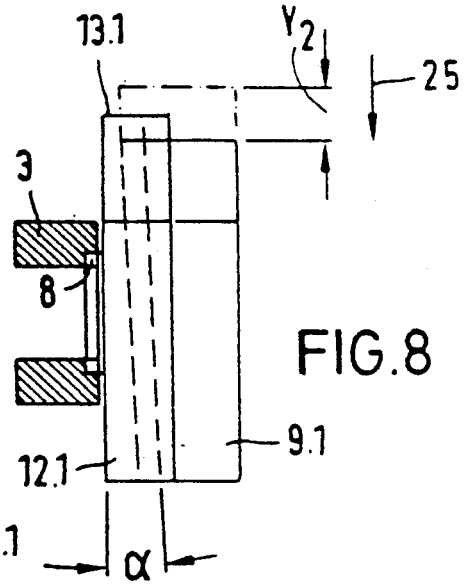

FIGS. 7 and 8 show for another embodiment a breech-block 9.1 and a slide face 10.1 extending from the bottom right to the top left as well as a correspondingly configured wedge-shaped insert 12.1. This arrangement differs from the embodiments shown in FIGS. 1 to 6 in that the sealing stroke $X_1$ (FIG. 4) of insert 12.1, once it has reached intermediate position 13.1, changes to a downward movement of breechblock 9.1 by stroke $Y_2$ in the downward direction 25. The change to the downward movement of breechblock 9.1 may be effected in a continuous manner, not shown, by means of a slide block guided in a track.

We claim:

1. A breech mechanism for a gun having a gun barrel with a bore axis and an obturator ring disposed at a breech end surface of said gun barrel, said breech mechanism including: a breech ring which is disposed at a breech end of said gun barrel and which has a parallel guideway extending at a right angle to said bore axis; a breechblock displaceably guided in said guideway for movement in a direction transverse to said bore axis, said breechblock having a sloped slide face which faces said breech end of said gun barrel and which extends at an angle relative to said parallel guideway, and having a wedge-shaped insert for obturation; said wedge-shaped insert having a sloped slide face slidably engaging said sloped slide face of said breechblock and an opposite frontal face which extends perpendicular to said bore axis and is configured as a sealing face for said obturator ring; connecting means, configured as a spring element mounted on said breechblock below said insert and connecting said insert to said breechblock, for causing said insert to normally move in synchronism with movement of said breechblock; and a stroke limiting means for interrupting movement of said insert, during movement of said breechblock in a direction toward a closed position, at an intermediate position when said front face of said insert is behind said obturator ring and aligned with said bore axis, and for causing said insert to perform a sealing stroke exclusively in a direction parallel to said bore axis and toward said obturator ring upon continued movement of said breechblock toward said closed position.

2. A breech mechanism according to claim 1, wherein said spring element is a gas pressure spring.

3. A breech mechanism according to claim 1, wherein: said stroke limiting means is a control cam disposed above said obturator ring, with said control cam being configured as a stop for said wedge-shaped insert and having a width which is greater than a maximum length of the sealing stroke.

4. A breech mechanism according to claim 1, wherein said stroke limiting means includes at least one cam track disposed on said breech ring and at least one cam on said wedge-shaped insert and engaging in said cam track, with said cam track being configured such that said wedge-shaped insert, in order to take up the intermediate position, performs a stroke exclusively in a direction transverse to said bore axis and, in order to perform the sealing stroke, moves exclusively in a direction parallel to said bore axis of said gun barrel.

5. A breech mechanism according to claim 1, wherein said obturator ring is a highly elastic sealing ring which, for its support, is provided with two overlapping rings of a wear resistant material located at an interior surface of said bore.

6. A breech mechanism according to claim 1 wherein said obturator ring is a plastic obturator.

* * * * *